US010640310B2

(12) United States Patent
Matsuura et al.

(10) Patent No.: US 10,640,310 B2
(45) Date of Patent: May 5, 2020

(54) SHEET FEEDING DEVICE AND PRINTING APPARATUS

(71) Applicant: CANON KABUSHIKI KAISHA, Tokyo (JP)

(72) Inventors: Masaaki Matsuura, Kawasaki (JP); Seiji Ogasawara, Machida (JP); Takaaki Ishida, Kawasaki (JP); Masakazu Tsukuda, Yokohama (JP); Shuichi Tokuda, Kawasaki (JP); Kazuki Matsuo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/222,336

(22) Filed: Dec. 17, 2018

(65) Prior Publication Data

US 2019/0193429 A1 Jun. 27, 2019

(30) Foreign Application Priority Data

Dec. 27, 2017 (JP) ..... 2017-250570

(51) Int. Cl.
*B65H 1/14* (2006.01)
*B65H 7/04* (2006.01)
(Continued)

(52) U.S. Cl.
CPC ..... *B65H 1/14* (2013.01); *B65H 1/04* (2013.01); *B65H 1/26* (2013.01); *B65H 3/44* (2013.01);
(Continued)

(58) Field of Classification Search
CPC ... B65H 1/08; B65H 1/14; B65H 7/04; B65H 7/02; B65H 2511/152; B65H 2511/20; B65H 2511/22; B41J 13/0018
See application file for complete search history.

(56) References Cited

U.S. PATENT DOCUMENTS 9,024,984 B2 5/2015 Akatsuka et al.
2010/0322689 A1* 12/2010 Ohtani ..... B65H 1/04 399/388
(Continued)

FOREIGN PATENT DOCUMENTS

JP S63-37014 B2 7/1988
JP 2013-180842 A 9/2013

OTHER PUBLICATIONS

U.S. Appl. No. 16/222,316, filed Dec. 17, 2018, Masakazu Tsukuda Seiji Ogasawara Takaaki Ishida Shuichi Tokuda Masaaki Matsuura Kazuki Matsuo Motoyuki Taguchi.

*Primary Examiner* — David H Bollinger
(74) *Attorney, Agent, or Firm* — Venable LLP

(57) ABSTRACT

A sheet feeding device and a printing apparatus capable of estimating a number of remaining sheets without error include a loading member on which sheets are loaded, a lift unit that moves the loading member up and down, a position detection unit that detects a lift-up position to which the loading member moves up, a sheet detection unit that detects that a sheet at an uppermost position of the sheets loaded on the loading member has moved up to a feeding position by an upward movement of the loading member, a feeding roller that feeds a sheet at the feeding position, and an estimation unit that estimates the number of remaining sheets loaded on the loading member based on a combination of detection results of the sheet detection unit and the position detection unit.

11 Claims, 17 Drawing Sheets

(51) Int. Cl.

| | |
|---|---|
| ***B65H 7/02*** | (2006.01) |
| ***B65H 5/26*** | (2006.01) |
| ***B65H 1/04*** | (2006.01) |
| ***B65H 3/44*** | (2006.01) |
| ***B65H 5/06*** | (2006.01) |
| ***B65H 1/26*** | (2006.01) |

(52) U.S. Cl.
CPC ..... *B65H 5/062* (2013.01); *B65H 5/26* (2013.01); *B65H 7/02* (2013.01); *B65H 2403/421* (2013.01); *B65H 2404/611* (2013.01); *B65H 2405/332* (2013.01); *B65H 2511/20* (2013.01); *B65H 2511/30* (2013.01); *B65H 2513/40* (2013.01); *B65H 2801/06* (2013.01)

(56) References Cited

U.S. PATENT DOCUMENTS

| | | | | |
|---|---|---|---|---|
| 2017/0102657 | A1* | 4/2017 | Yasuda ..... | B65H 1/00 |
| 2017/0361631 | A1 | 12/2017 | Matsuura et al. | |
| 2018/0334340 | A1* | 11/2018 | Inoue ..... | B65H 1/266 |

* cited by examiner

| | LARGE NUMBER OF SHEETS REMAIN | SMALL NUMBER OF SHEETS REMAIN | NO SHEET REMAINS |
|---|---|---|---|
| SHEET DETECTION SENSOR (83) | ON | ON | OFF |
| FIRST POSITION DETECTION SENSOR (81) | OFF | ON | ON |
| SECOND POSITION DETECTION SENSOR (82) | ON | ON | OFF |

FIG.17

SHEET FEEDING DEVICE AND PRINTING APPARATUS

BACKGROUND OF THE INVENTION

Field of the Invention

The present invention relates to sheet feeding devices including a function to estimate the number of remaining sheets and printing apparatuses including the same.

Description of the Related Art

Japanese Patent Laid-Open No. 2013-180842 discloses a method in which an intermediate plate on which sheets are loaded is disposed in a tray so as to be movable up and down, and the number of remaining sheets on the intermediate plate is estimated using a sheet presence detection sensor and a sheet-upper-surface detection sensor. The sheet presence detection sensor is disposed at a position facing the upper surface of the intermediate plate and turns on, when there are sheets on the intermediate plate, by the rotation of a lever that comes into contact with the sheets when the intermediate plate moves up. The sheet-upper-surface detection sensor disposed near a pick-up roller for feeding sheets turns on when the sheets on the intermediate plate move up to a predetermined feeding position. The number of remaining sheets on the intermediate plate is estimated, when the intermediate plate moves up, according to the time difference from when the sheet presence detection sensor turns on to when the sheet-upper-surface detection sensor turns on.

However, in this method of estimating the number of remaining sheets based on the time difference between the detection timings of these two sensors, the estimation result on the number of remaining sheets may have some error because the upward movement speed of the intermediate plate is likely to vary depending on the number of remaining sheets.

SUMMARY OF THE INVENTION

An object of the present invention is to provide a sheet feeding device and a printing apparatus that are capable of estimating the number of remaining sheets without errors.

In the first aspect of the present invention, there is provided a sheet feeding device comprising: a loading member on which sheets are loaded; a lift unit that moves the loading member up and down; a position detection unit that detects a lift-up position to which the loading member moves up; a sheet detection unit that detects that a sheet at an uppermost position of the sheets loaded on the loading member has moved up to a feeding position by an upward movement of the loading member; a feeding roller that feeds a sheet at the feeding position; and an estimation unit that estimates the number of remaining sheets loaded on the loading member, based on a combination of detection results of the sheet detection unit and the position detection unit.

In the second aspect of the present invention, there is provided a printing apparatus comprising a sheet feeding device including a loading member on which sheets are loaded; a lift unit that moves the loading member up and down; a position detection unit that detects a lift-up position to which the loading member moves up; a sheet detection unit that detects that a sheet at an uppermost position of the sheets loaded on the loading member has moved up to a feeding position by an upward movement of the loading member; a feeding roller that feeds a sheet at the feeding position; an estimation unit that estimates the number of remaining sheets loaded on the loading member based on a combination of detection results of the sheet detection unit and the position detection unit; and a printing unit that performs printing on the sheet fed by the sheet feeding device.

The present invention combines the detection result on the lift-up position of the loading member on which sheets are loaded and the detection result indicating that a sheet at the uppermost position of the sheets loaded on the loading member has moved up to the feeding position, and estimates the number of remaining sheets based on the combination without errors.

Further features of the present invention will become apparent from the following description of exemplary embodiments with reference to the attached drawings.

BRIEF DESCRIPTION OF THE DRAWINGS

FIG. 17 is an explanatory diagram for the relationship between the detection results of sensors and the number of remaining printing media.

DESCRIPTION OF THE EMBODIMENTS

Figure 1:
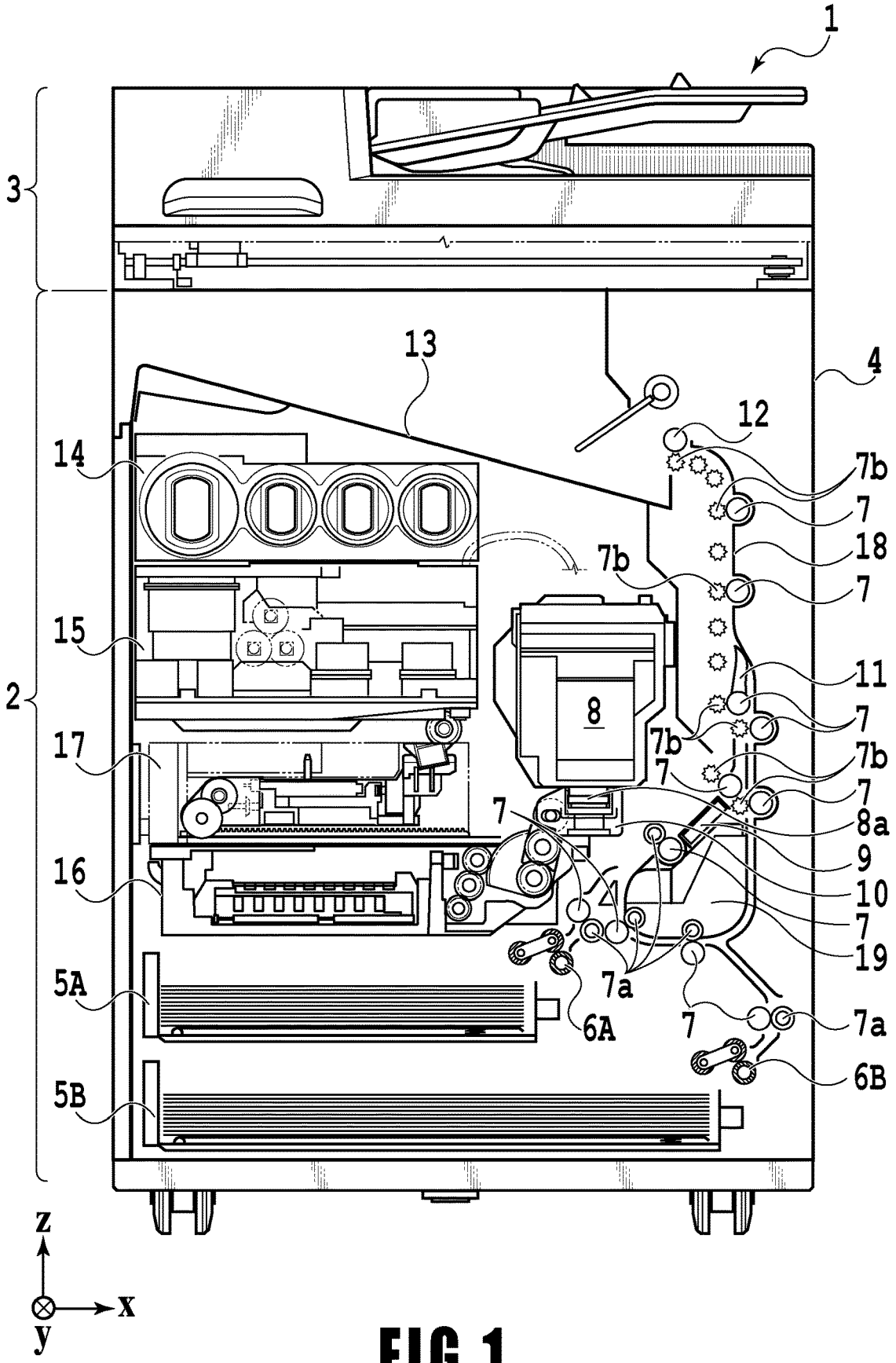
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing media (cut sheets) S are detachably provided at the bottom of a casing 4 in the vertical direction. Relatively small printing media of up to A4 size are stacked and housed in the first cassette 5A and relatively large printing media of up to A3 size are stacked and housed in the second cassette 5B. A first feeding unit 6A for feeding housed printing media one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a,* spurs 7*b,* a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing mediums S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 (described later) such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
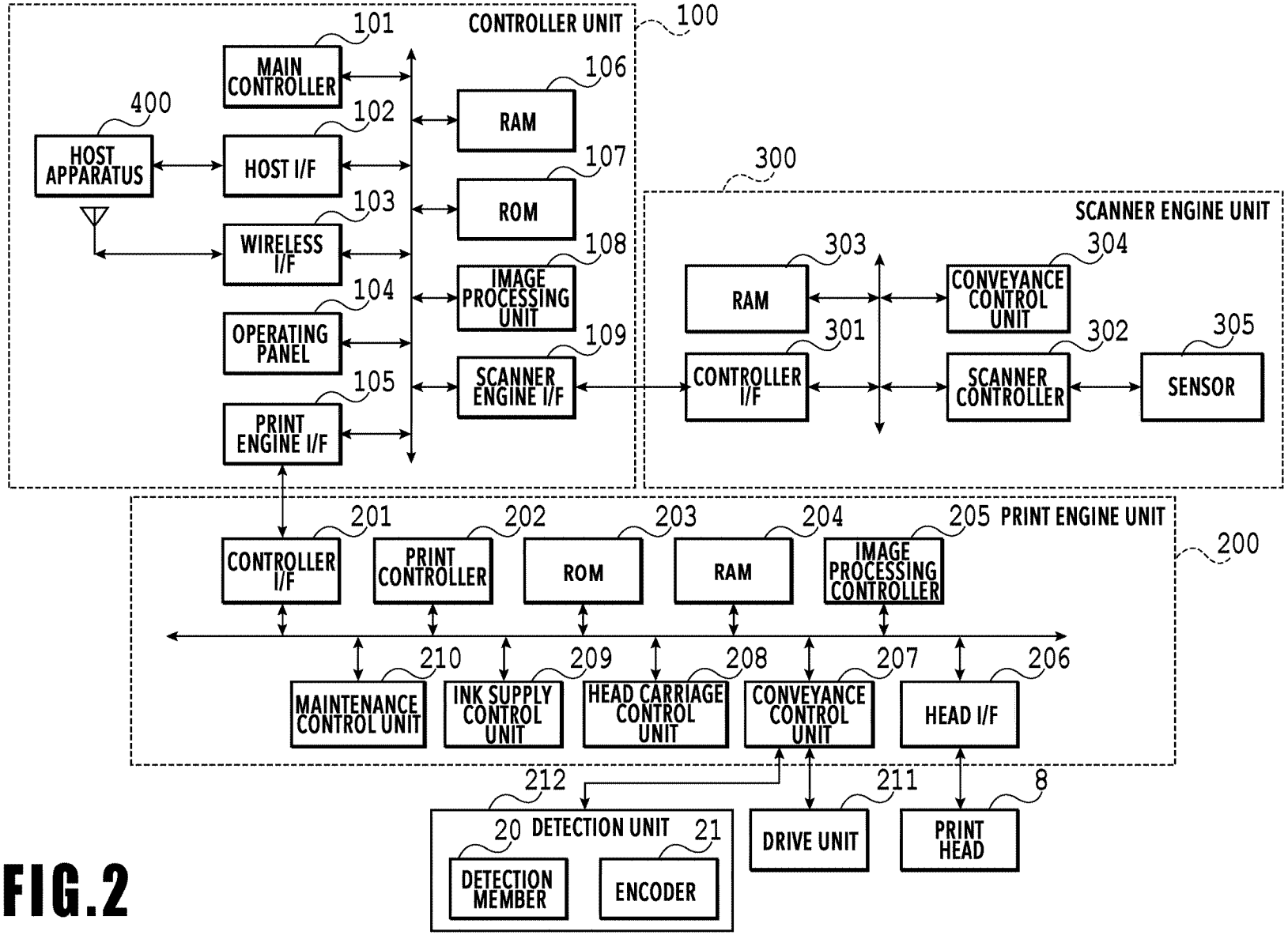
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can input an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Printing is performed in the course of the conveyance of the printing medium S by the conveyance control unit 207, by the print head 8 performing print operation under instructions from the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
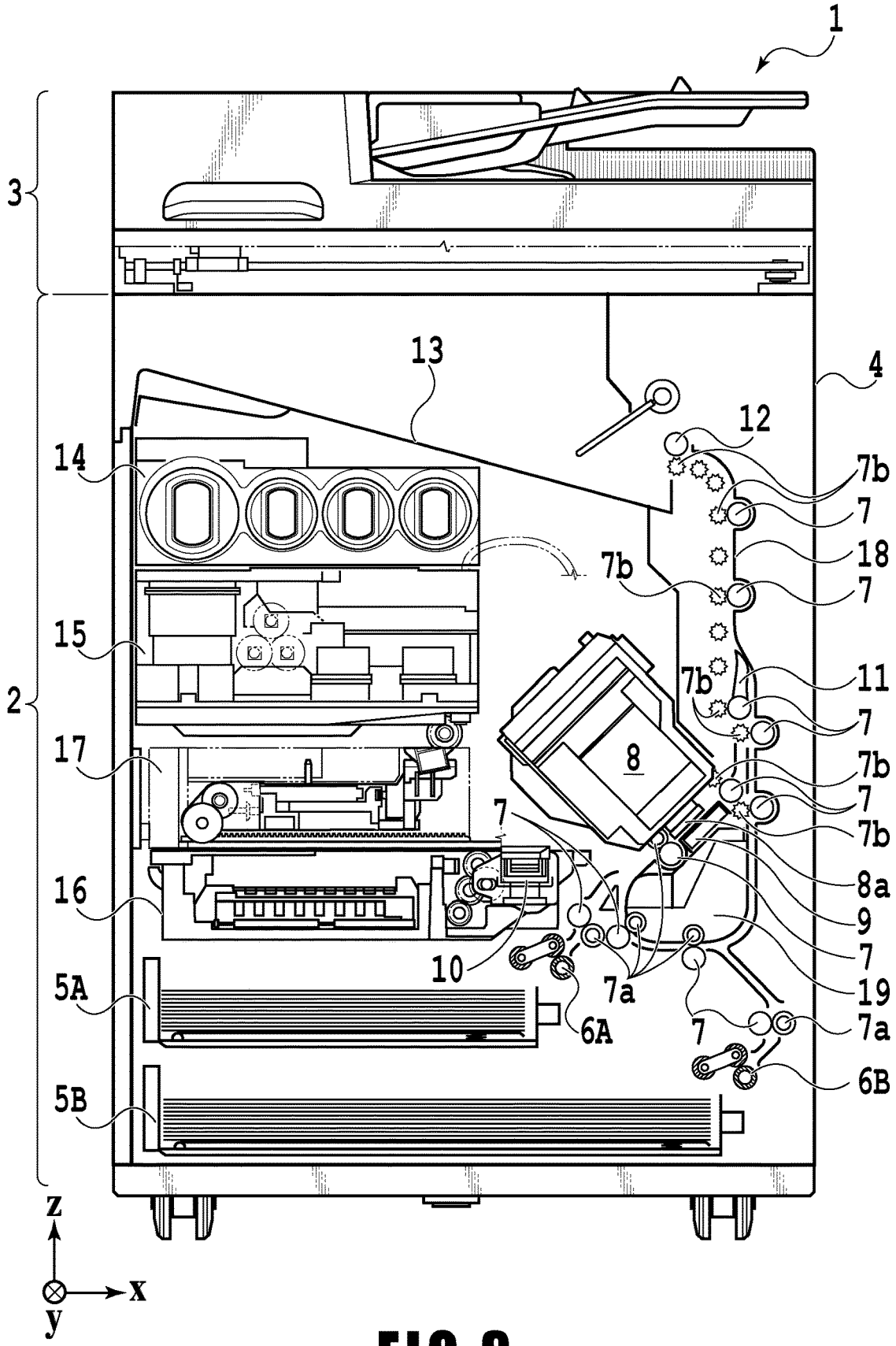
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
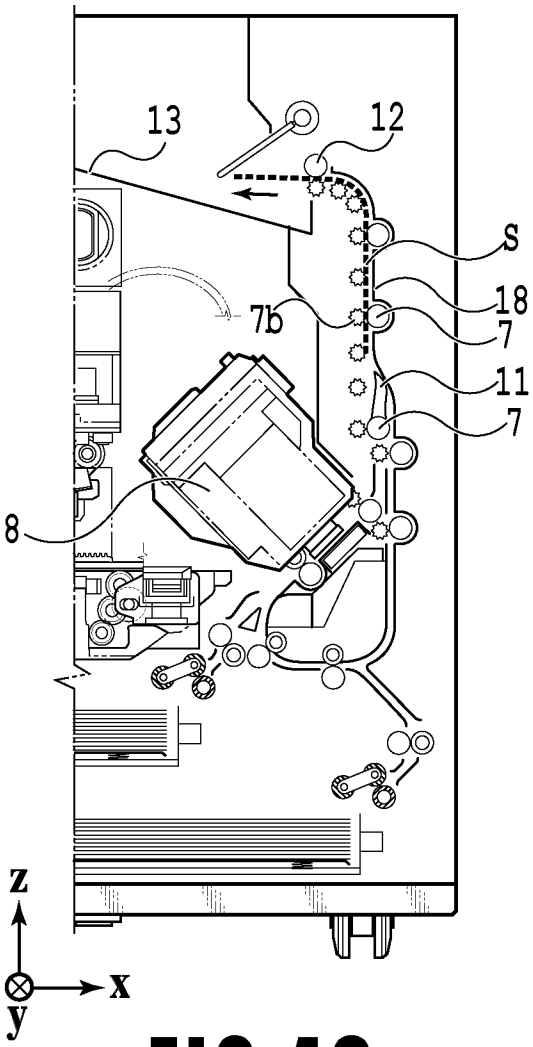
FIG. 4A, FIG. 4B, and FIG. 4C are views of a conveying path of a print medium fed from a first cassette.
Figure 4B:
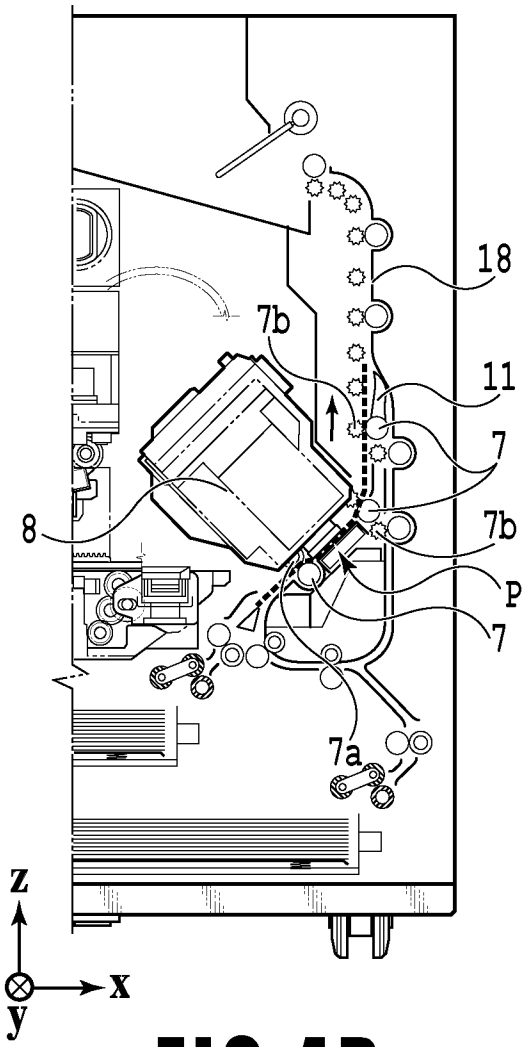
Figure 4A:
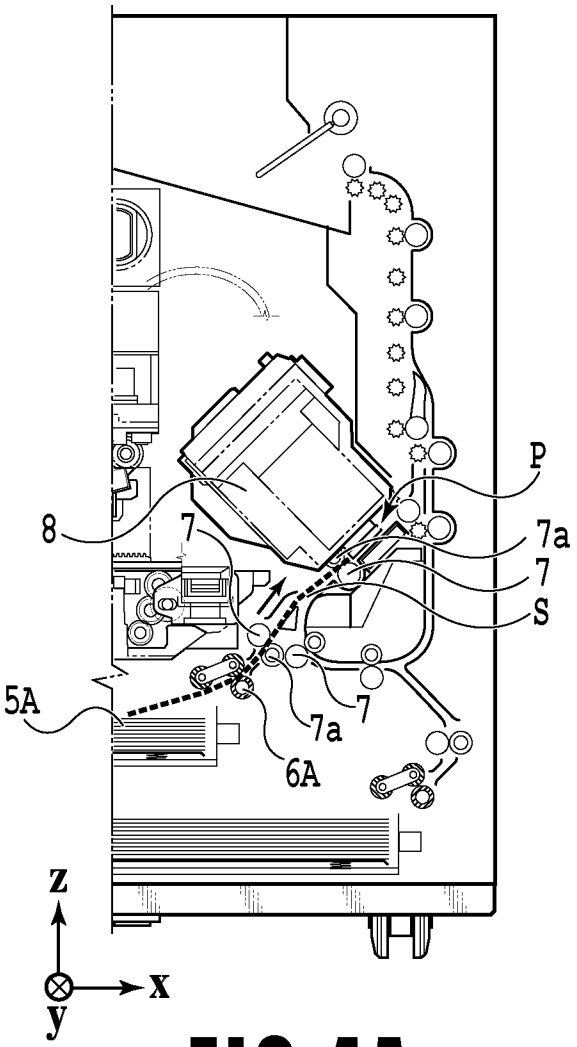

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
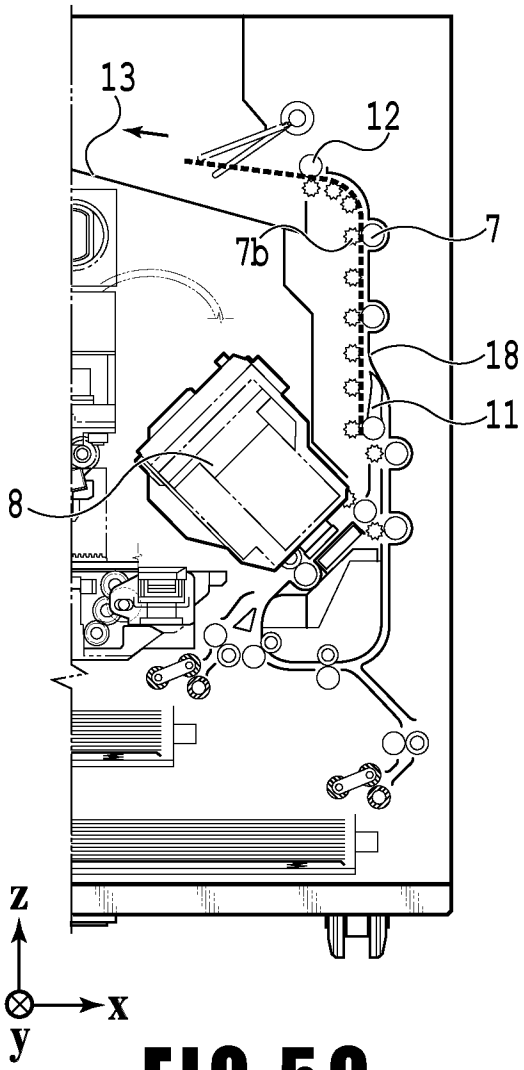
FIG. 5A, FIG. 5B, and FIG. 5C are views of a conveying path of a print medium fed from a second cassette.
Figure 5B:
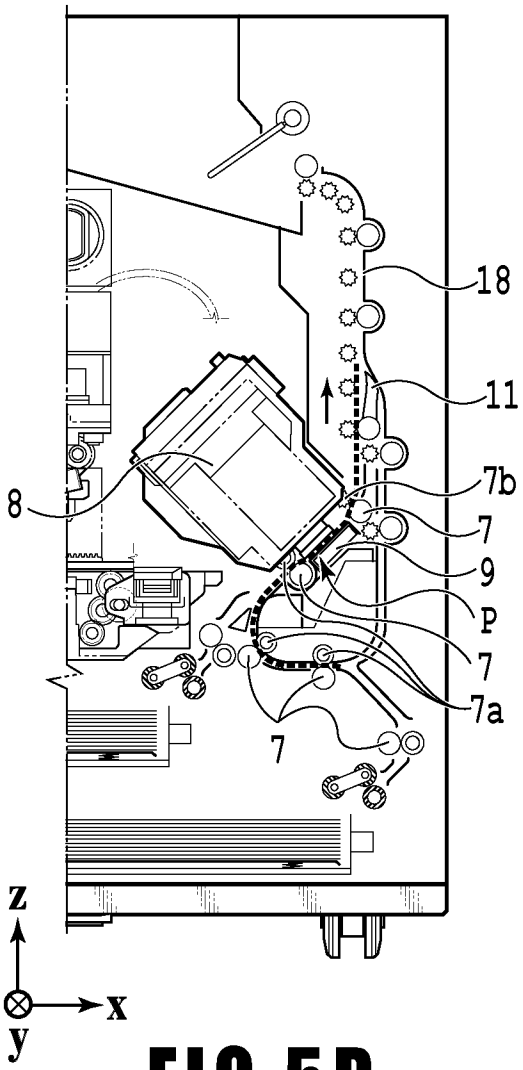
Figure 5A:
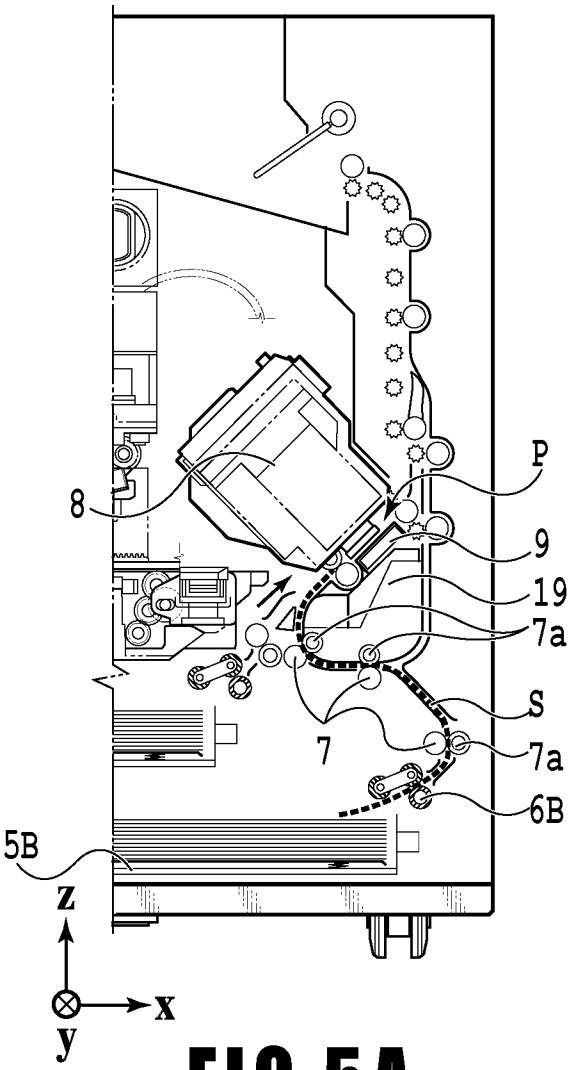

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
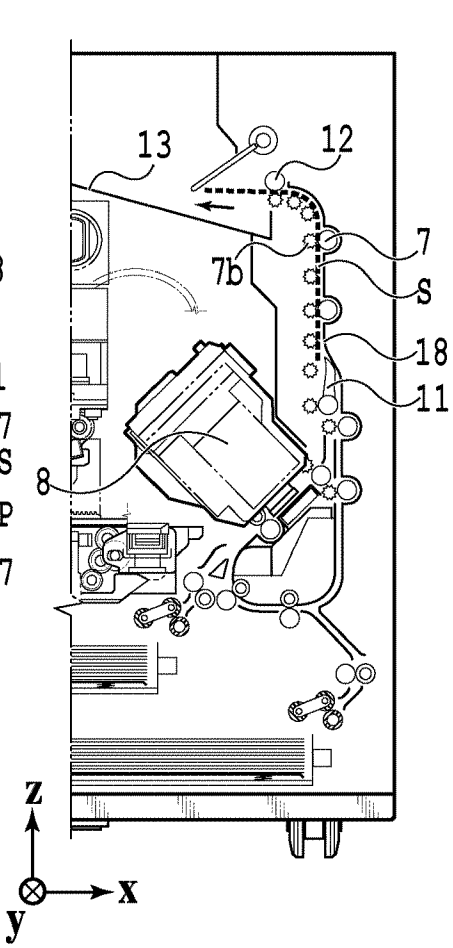
FIG. 6A, FIG. 6B, FIG. 6C, and FIG. 6D are views of views of a conveying path used in a case of performing a print operation on the back surface of a print medium.
Figure 6C:
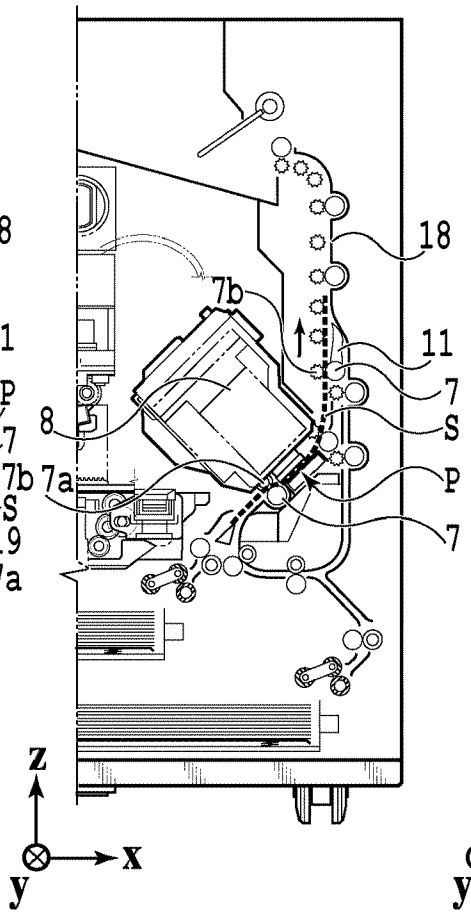
Figure 6B:
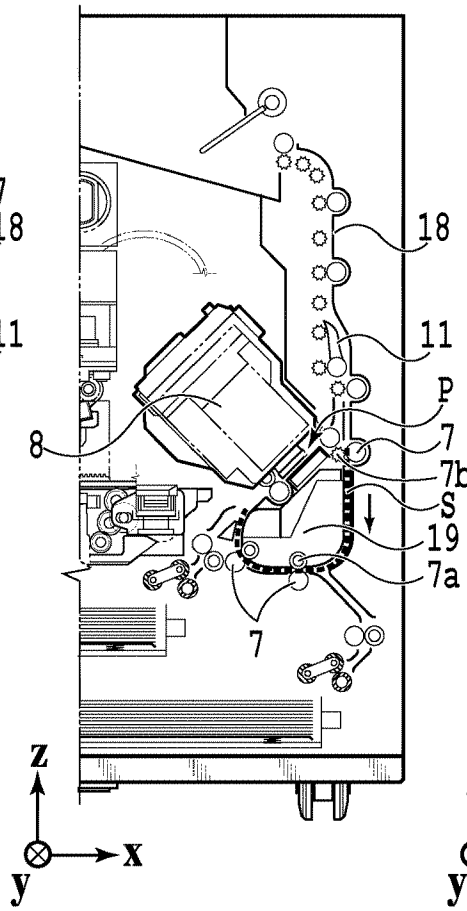
Figure 6A:
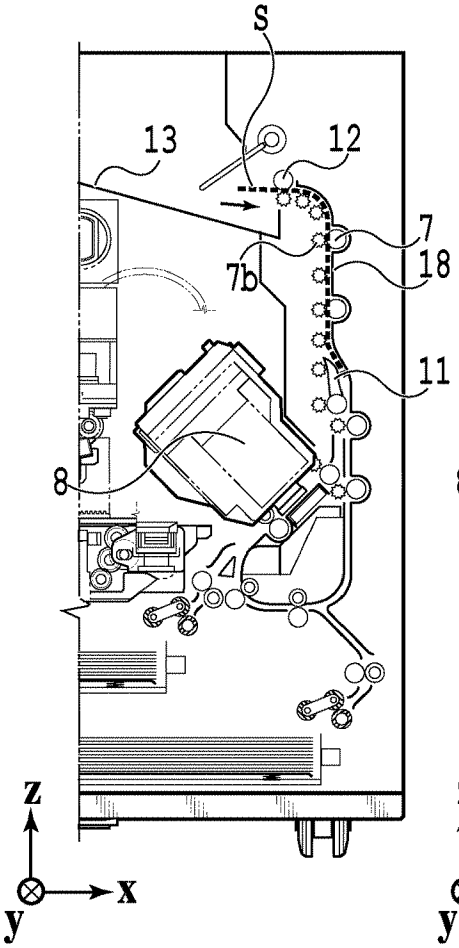

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
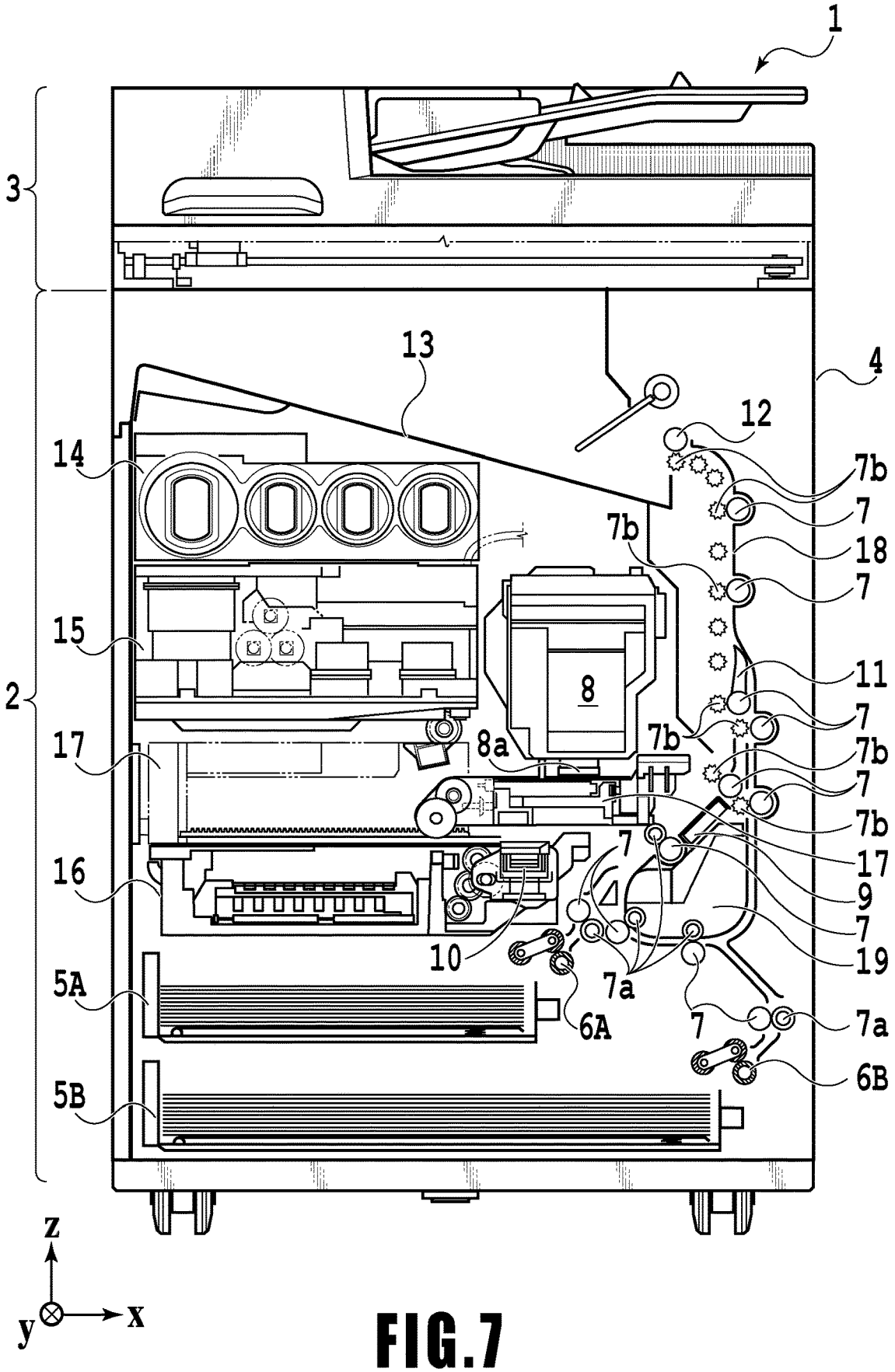
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
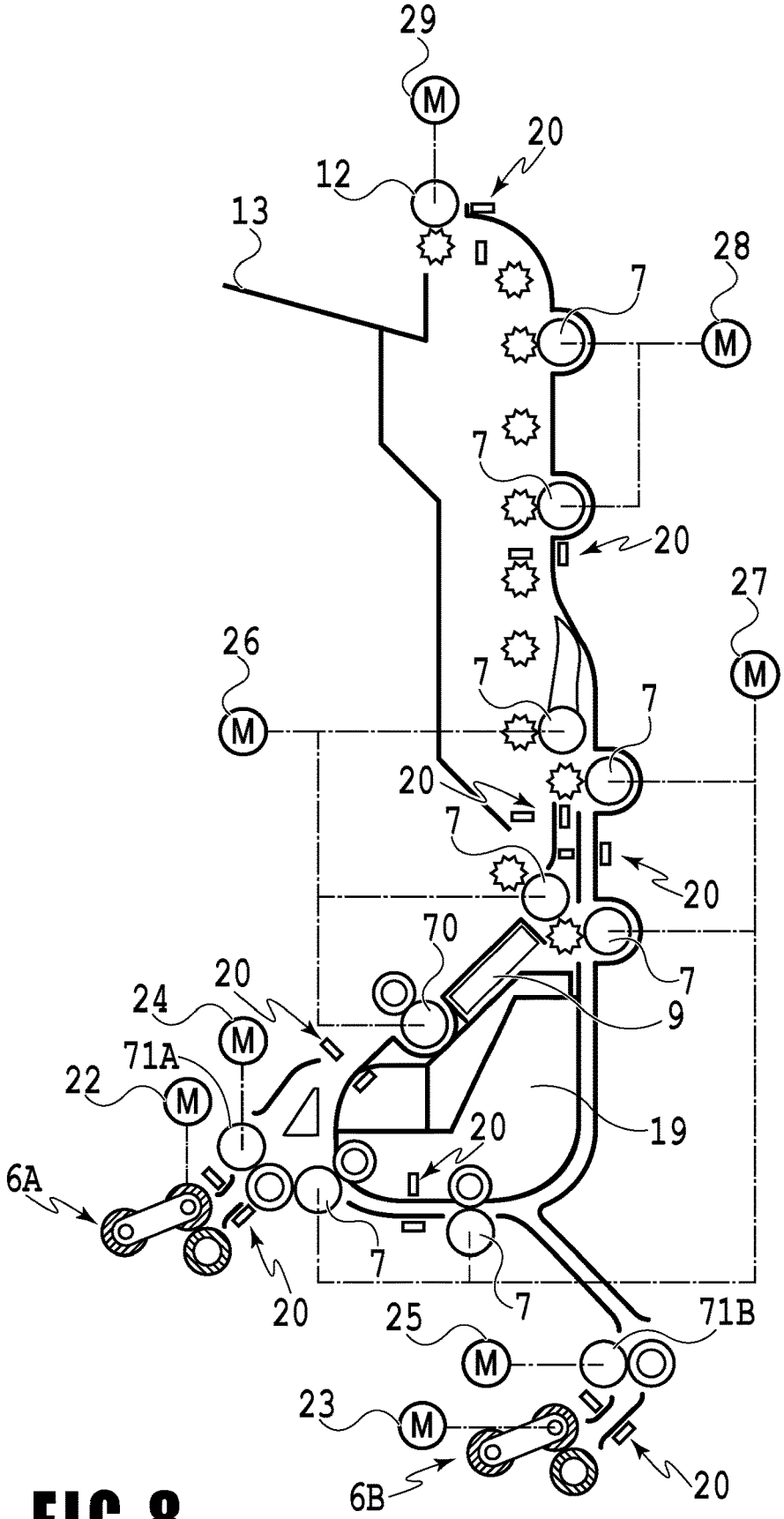
FIG. 8 is a diagram illustrating the relationship between drive rollers and motors.

FIG. 8 is a diagram illustrating the relationships between multiple motors and drive rollers in the printing apparatus 1. A first feeding motor 22 drives the first feeding unit 6A for feeding printing media S from the first cassette 5A. A second feeding motor 23 drives the second feeding unit 6B for feeding printing media S from the second cassette 5B. A first conveying motor 24 drives a first intermediate roller 71A which first conveys a printing medium S fed by the first feeding unit 6A. A second conveying motor 25 drives a second intermediate roller 71B which first conveys a printing medium S fed by the second feeding unit 6B.

A main conveying motor 26 drives a main conveying roller 70 which is disposed upstream of the platen 9 and mainly conveys the printing medium S being printed. The main conveying motor 26 also drives two conveying rollers 7 that are disposed downstream of the platen 9 and conveys the printing medium S conveyed by the main conveying roller 70, further downstream.

A third the conveying motor 27 drives two conveying rollers 7 that convey downward the printing medium S the first side of which has been printed. The third the conveying motor 27 also drives two conveying rollers 7 disposed along the inner guide 19. These two conveying rollers 7 convey, toward the print head 8, a printing medium S fed from the second cassette 5B and conveyed by the second intermediate roller 71B or a printing medium S the first side of which has been printed and the front and back sides have been reversed.

A fourth conveying motor 28 drives two conveying rollers 7 that convey upward or downward a printing medium S that has been printed. A discharging motor 29 drives a discharging roller 12 for discharging a printing medium S that has been printed, to the discharging tray 13. As described above, the two feeding motors 22 and 23, the five conveying motors 24 to 28, and the discharging motor 29 each are associated with one or more drive rollers.

In addition, at eight positions along the conveying path are disposed detection members 20 for detecting the printing medium S. Each detection member 20 includes a sensor and mirror disposed on opposite sides of the conveying path. The sensor having a light emitting unit and a light receiving unit is disposed on one side of the conveying path, and the mirror is disposed on the other side of the conveying path, at a position facing the sensor. Each detection member 20 checks whether the light receiving unit has detected light emitted from the light emitting unit of the sensor and then reflected by the mirror to judge if a printing medium S is present, in other words, if the leading edge or the trailing edge has passed.

The conveyance control unit 207 drives the feeding motors 22 and 23, the conveying motors 24 to 28, and the discharging motor 29 separately based on detection results of the multiple detection members 20 and the output values of encoders for detecting the amount of rotation of the drive rollers, and thus controls the conveyance operation as the entire apparatus.

Figure 9:
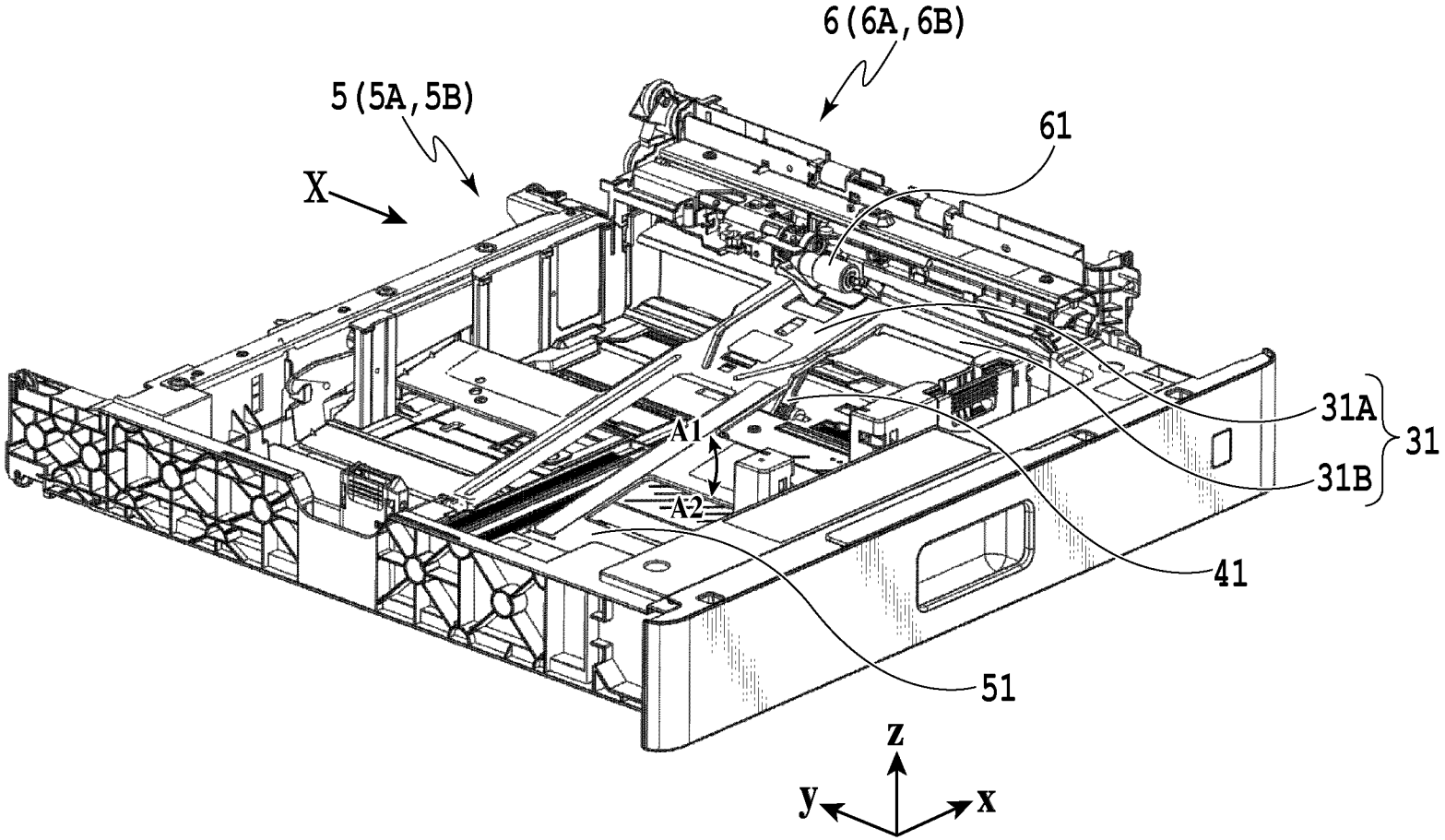
FIG. 9 is a perspective view of a cassette and a feeding unit.
Figure 10:
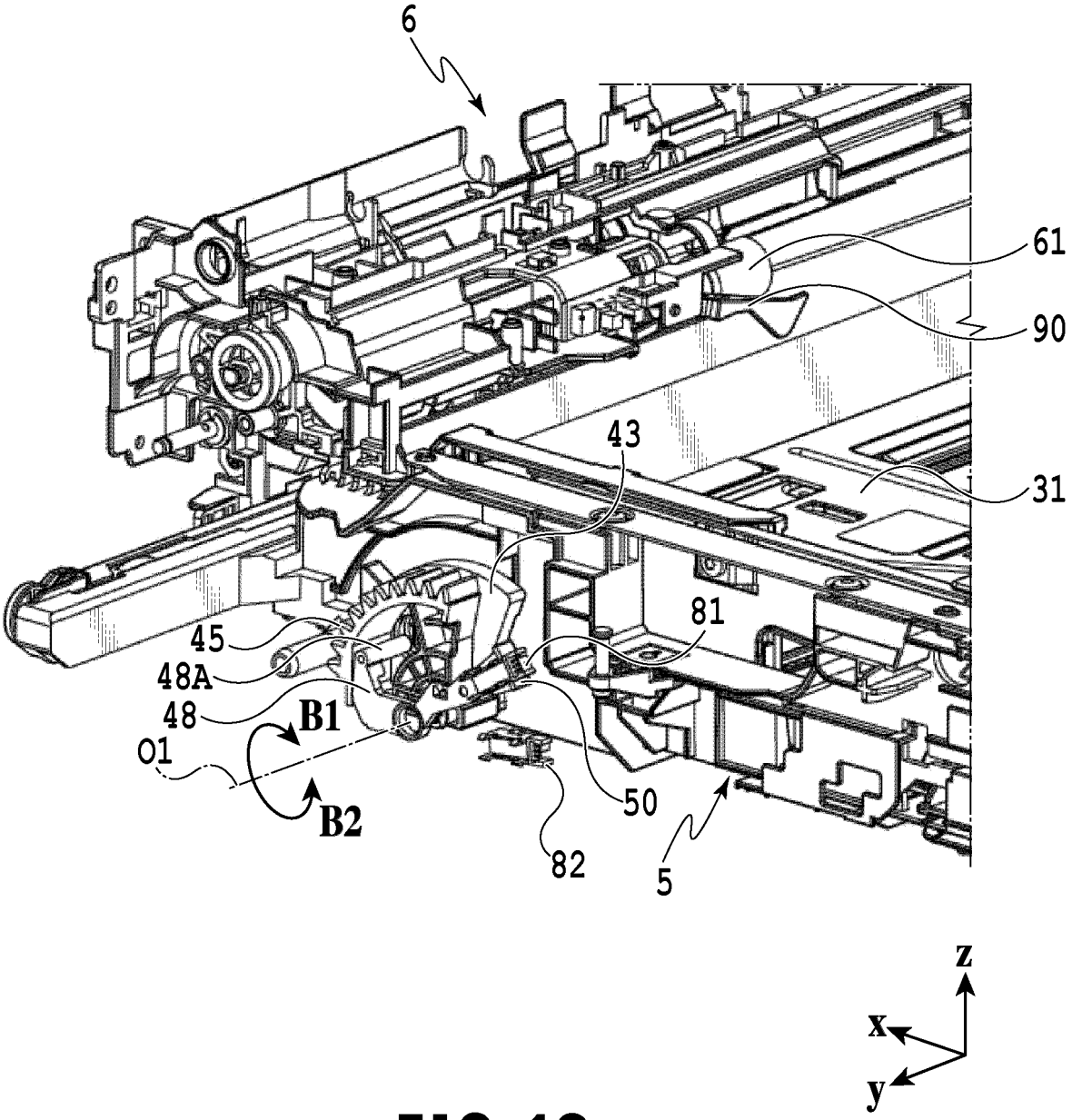
FIG. 10 is a view taken along arrow X in FIG. 9.

FIG. 9 is a perspective view of the cassette 5 for the printing media (cut sheets) S and the feeding unit 6. The first cassette 5A and the second cassette 5B in FIG. 1 have the same structure, and thus these are collectively described as the cassettes 5. In addition, the first feeding unit 6A and the second feeding unit 6B in FIG. 1 also have the same structure, and thus, these are also collectively described as feeding units 6.

The cassette 5 is pulled out in the −y direction from the casing 4 illustrated in FIG. 1, printing media S are loaded in the cassette 5, and then the cassette 5 is pushed in in the +y direction to be set in the casing 4. A pick-up roller 61 in the feeding unit 6 picks up the uppermost one of the printing media S loaded in the cassette 5 and sends it in the feeding direction along the x direction. The cassette 5 includes an intermediate plate (loading member) 31 for supporting the printing media S and a lift lever 41 to move up and down the intermediate plate 31 so that a large number of printing media S can be loaded. The intermediate plate 31 is formed in an approximately T-shaped plane, and the center portion 31A of the intermediate plate 31 extends in the x direction. The distal end portion 31B of the center portion 31A extends from the distal end of the center portion 31A in the +y direction and −y direction. The proximal end of the center portion 31A is attached to the bottom portion 51 of the cassette 5 at a specified position to be rotatable in the up-down direction indicated by arrows A1 and A2.

FIGS. 10 to 13 are explanatory diagrams for a drive mechanism for moving the intermediate plate 31 up and down.

Figure 11:
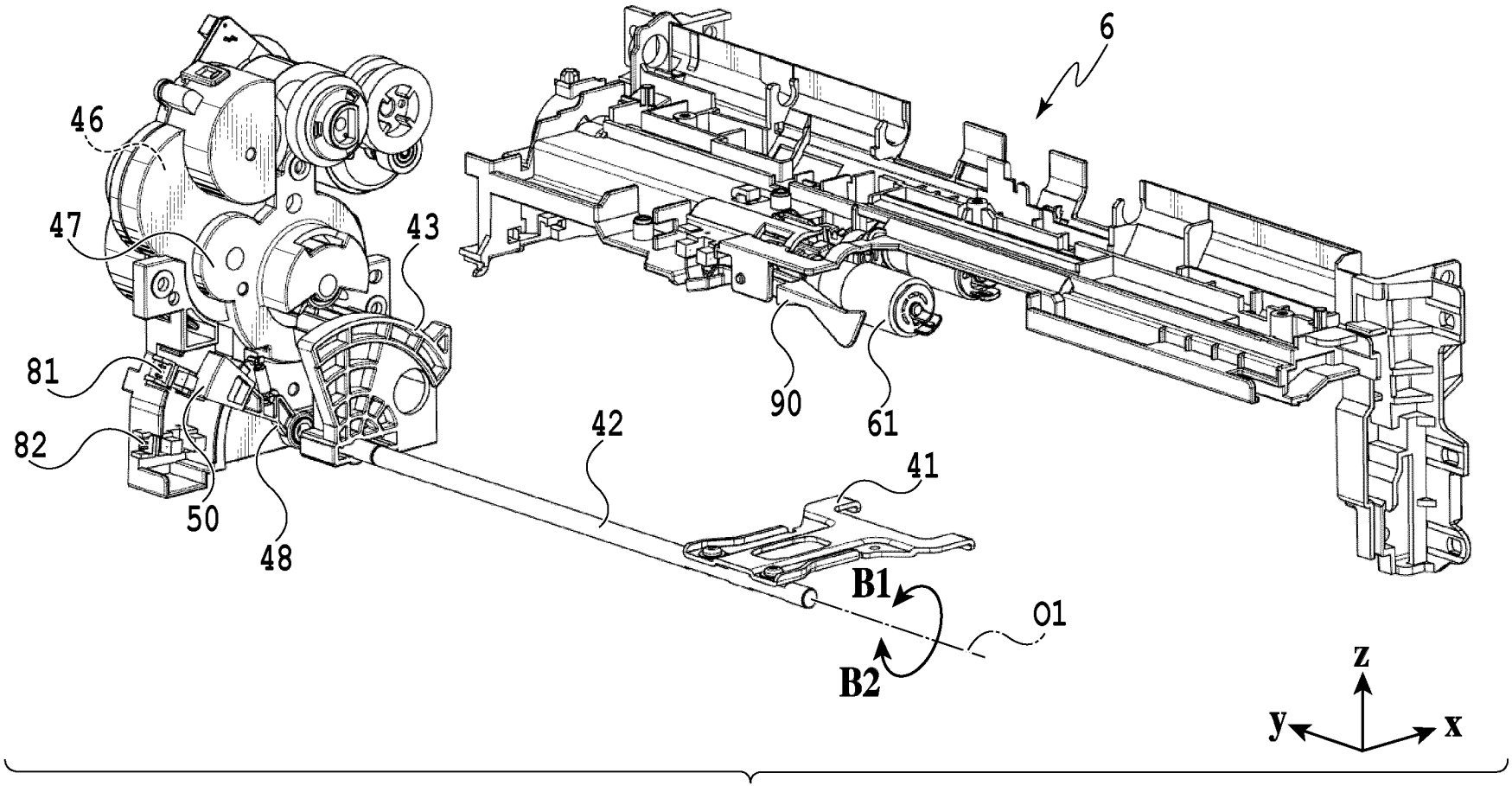
FIG. 11 is a perspective view of a lift mechanism for an intermediate plate and the feeding unit.
Figure 12:
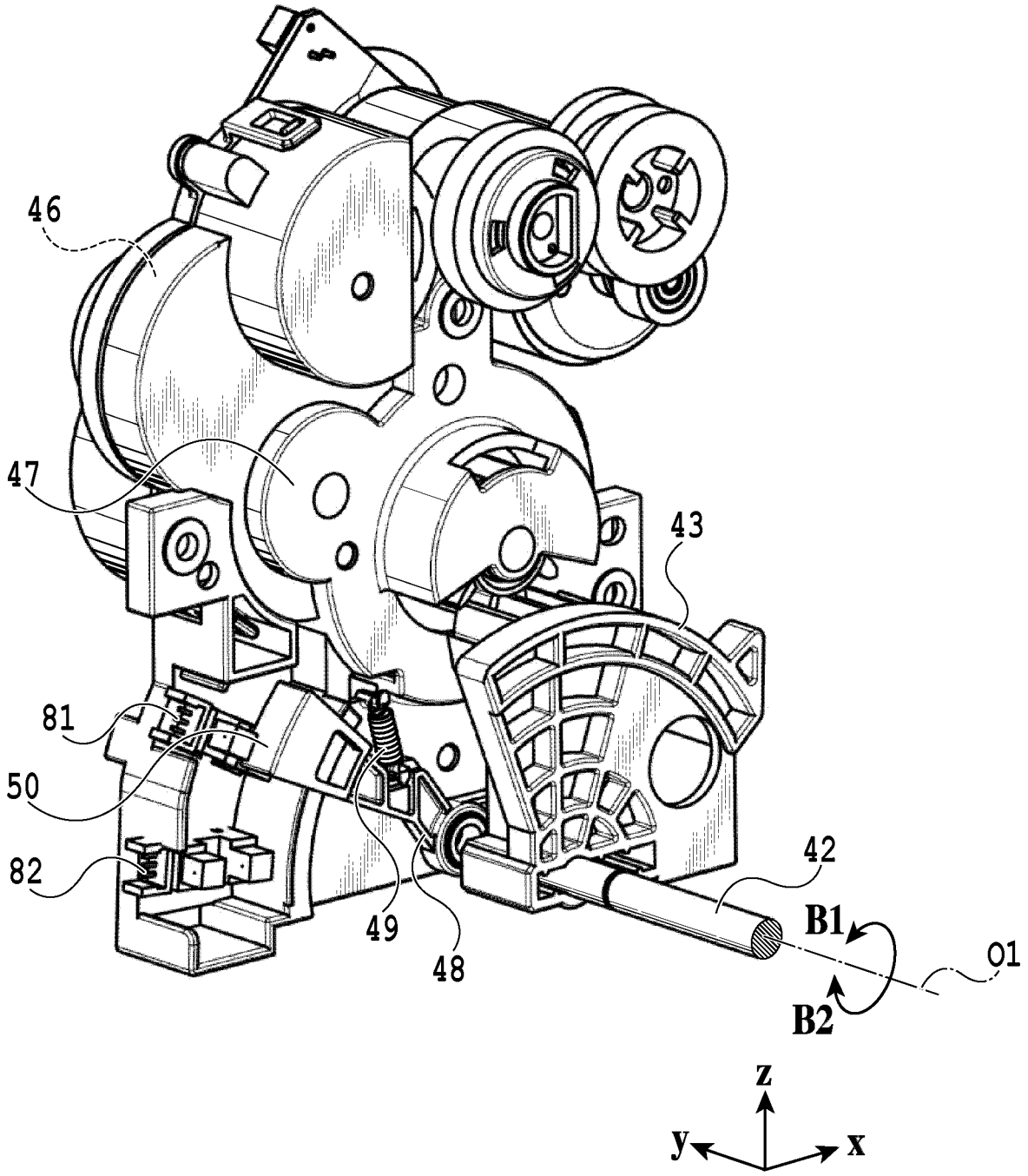
FIG. 12 is an enlarged perspective view of the lift mechanism for the intermediate plate.
Figure 13:
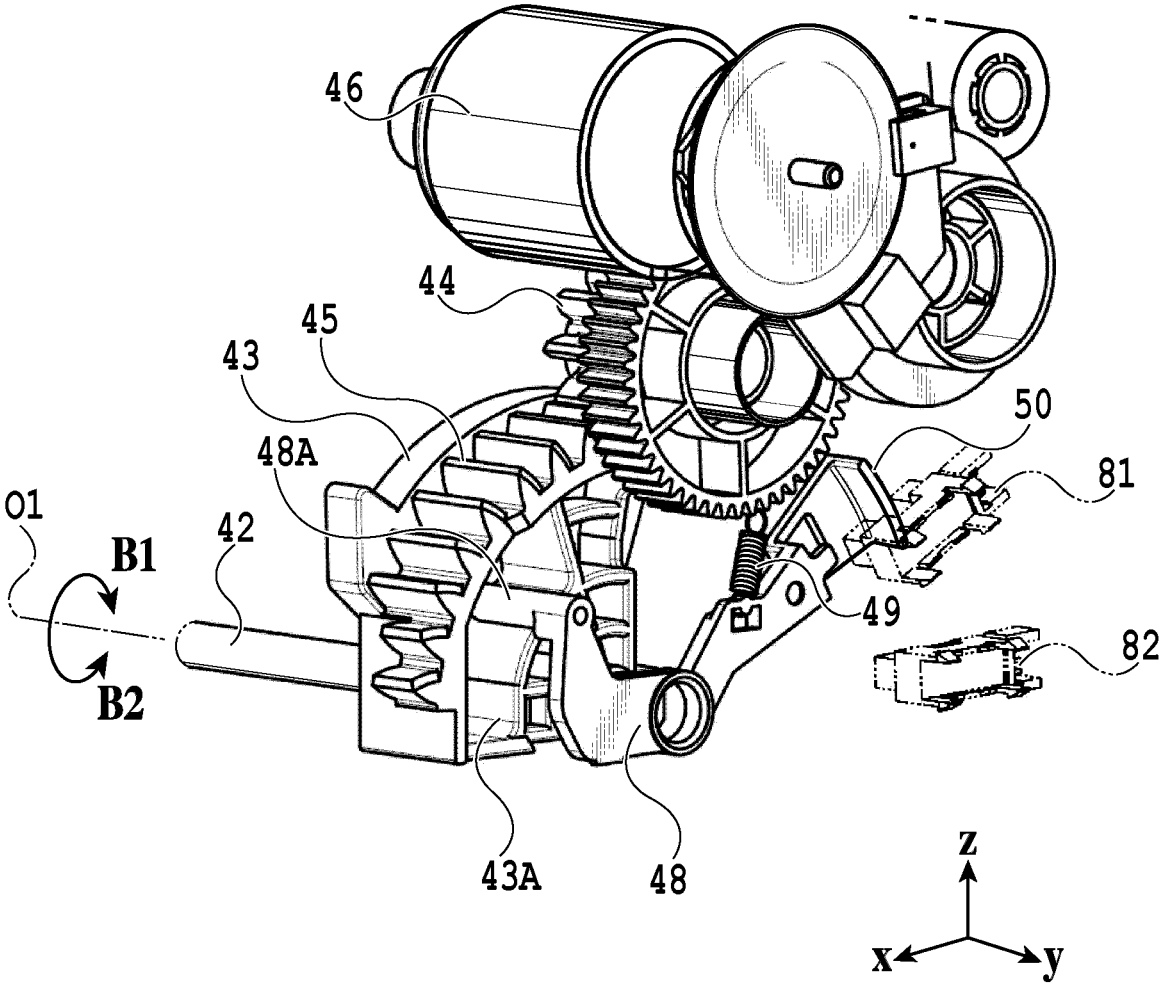
FIG. 13 is an enlarged perspective view of the inside of the lift mechanism for the intermediate plate.

The lift lever 41 located under the intermediate plate 31 is attached to one end of the shaft 42 which is rotatable around the axis O1 in the directions indicated by the arrows B1 and B2 in FIG. 11. The shaft 42, extending in they direction, is attached to the bottom portion 51 of the cassette 5 at a specified position to be rotatable in the directions indicated by the arrows B1 and B2. When the shaft 42 rotates in the directions indicated by the arrows B1 and B2, the intermediate plate 31 is moved up and down in the directions indicated by the arrows A1 and A2 by means of the lift lever 41 as in FIGS. 14A, 14B, 14C, and 14D.

To the other end of the shaft 42 is attached a fan-shaped rotation member 43, and on the outside (in the y direction) of the rotation member 43 is provided a fan-shaped driven gear 45 which engages with a driving gear 44. The driving gear 44 is connected to the motor 46 via a gear train. According to the rotation direction of the motor 46, the shaft 42 is rotated in the directions indicated by the arrows B1 and B2 together with the lift lever 41 via the driving gear 44 and the driven gear 45. A case 47 housing the driving gear 44 and the drive unit (including the motor 46 and the gear train) is disposed at a specified position in the casing 4. When the cassette 5 is pushed in in the +y direction and set at a position inside the main body of the printing apparatus, the driven gear 45 comes into engagement with the driving gear 44, forming a power transmission system between the motor 46 and the rotation member 43. On the other hand, when the cassette 5 is pulled out in the −y direction and moved to a position outside the main body of the printing apparatus, the driven gear 45 disengages from the driving gear 44, canceling the power transmission system between the motor 46 and the rotation member 43. Thus, the cassette 5 can be moved with small operation force without being affected by the drive unit including the motor 46 and the gear train.

Attached to the case 47 is the intermediate portion of a first lever 48 which is rotatable around the axis O1, which is also the axis of the shaft 42, in the directions indicated by the arrows B1 and B2. The lever 48 is biased in the B2 arrow direction by a spring 49 provided between one end of the lever 48 and a specified position of the case 47, and the rotation limit in the arrow B2 direction, determined by a not-illustrated stopper, is a position indicated by P30 in FIG. 14A. Attached to one end of the lever 48 is a light shielding plate 50, and formed at the other end of the lever 48 is a connecting portion 48A which is positioned inside a slit 43A of the rotation member 43. By means of these slit 43A and connecting portion 48A, the lever 48 rotates in association with the rotation member 43 as described later. At specified positions on the case 47 are attached a first position detection sensor 81 and a second position detection sensor 82, which are optical sensors each including a light emitting unit and a light receiving unit, as position detection sensors for detecting the lift-up position to which the intermediate plate 31 moves up. The light shielding plate 50 moves, along with the rotation of the lever 48, so as to draw a locus passing a light path between the light emitting unit and the light receiving unit of each of the first position detection sensor 81 and the second position detection sensor 82.

Figure 15A:
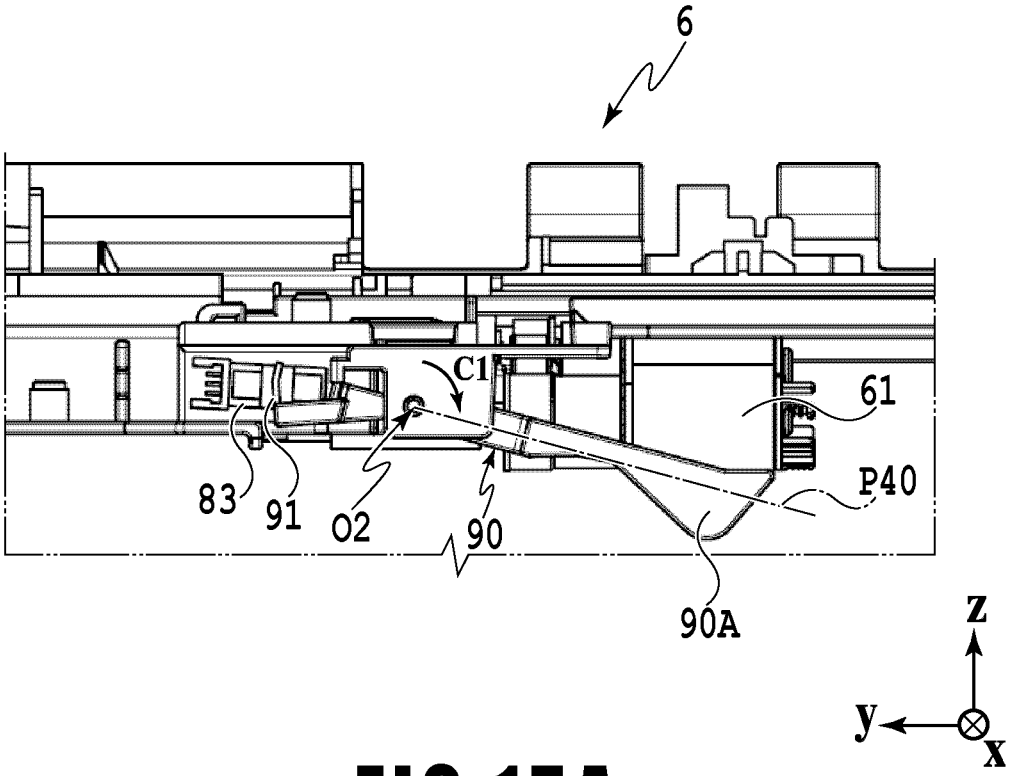
FIGS. 15A and 15B are explanatory diagrams for a sheet detection sensor.
Figure 15B:
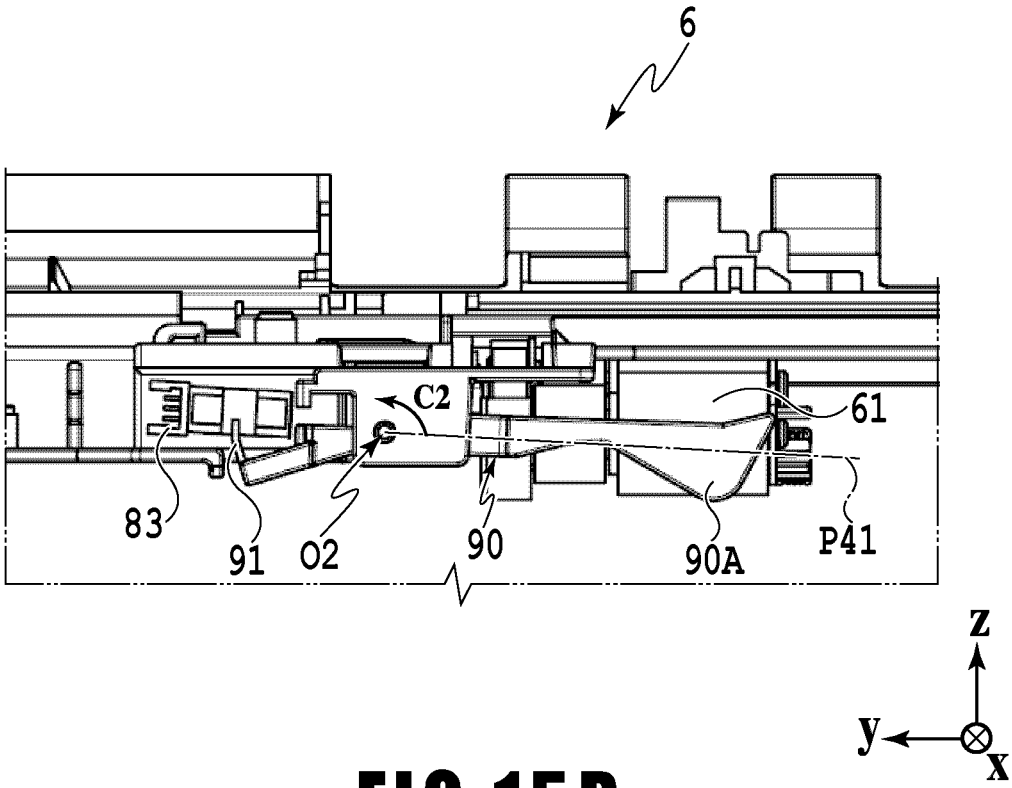

As illustrated in FIGS. 15A and 15B, the intermediate portion of a second lever 90 is attached to the feeding unit 6 at a specified position to be rotatable around the axis 02 of the x direction, in the directions indicated by the arrows C1 and C2. At one end of lever 90 is formed a contact portion 90A configured to come into contact with the upper surface of the printing media S loaded in the cassette 5, and to the other end of the lever 90 is attached a light shielding plate 91. The feeding unit 6 includes a sheet detection sensor 83, which is an optical sensor including a light emitting unit and a light receiving unit and attached at a specified position, as a sheet detection sensor for detecting that the printing medium S at the uppermost position of the printing media S loaded on the intermediate plate 31 has moved up to a predetermined feeding position. The light shielding plate 91 moves along with the rotation of the lever 90 so as to draw a locus passing a light path between the light emitting unit and the light receiving unit of the sheet detection sensor 83. The lever 90 is biased in the arrow C1 direction as illustrated in FIG. 15A by its own weight or a spring, and the contact portion 90A is rotated in the arrow C2 direction by the contact with the upper surface of the printing media S loaded in the cassette 5.

Figure 16:
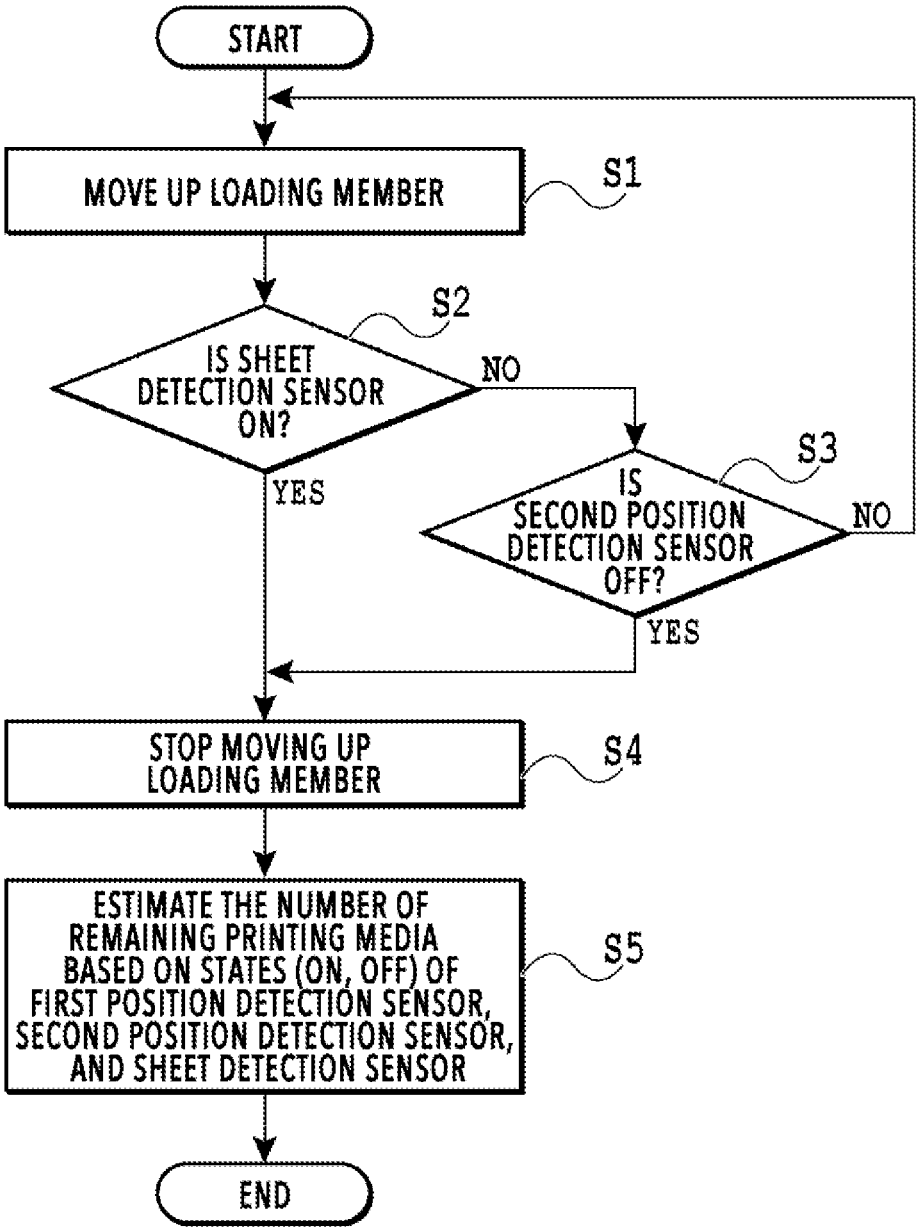
FIG. 16 is a flowchart for explaining a process for estimating the number of remaining printing media.

FIG. 16 is a flowchart for explaining an estimation process for estimating the number of remaining printing media S loaded in the cassette 5.

Figure 14B:
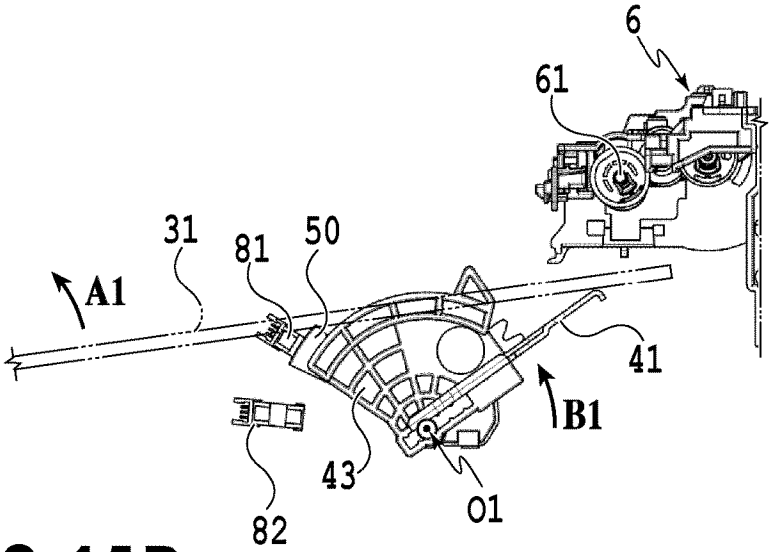
FIGS. 14A, 14B, 14C, and 14D are diagrams for explaining the operation of the lift mechanism for the intermediate plate.
Figure 14D:
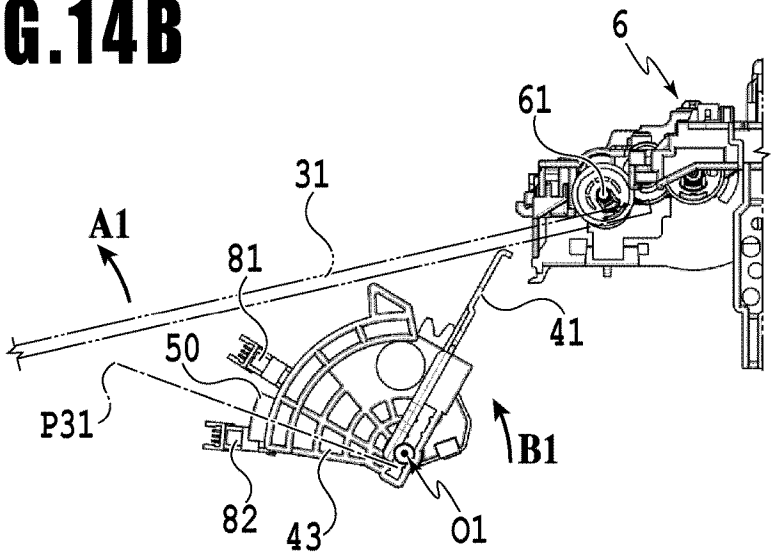
Figure 14A:
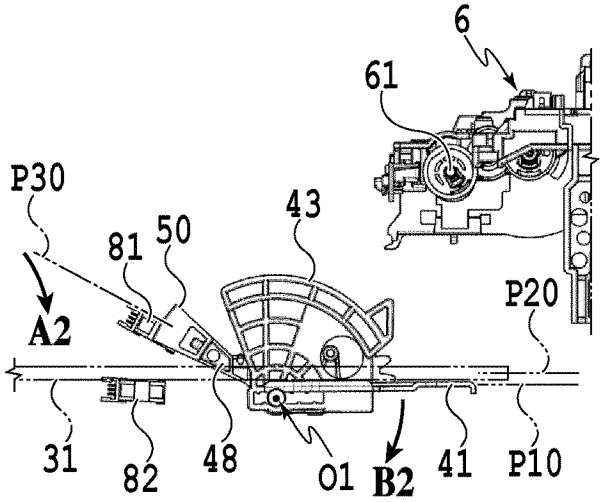

FIG. 14A illustrates a standby state in which the lift lever 41 is at the standby position (the rotation limit position in the arrow B2 direction) P10. In this standby state, the intermediate plate 31 on which printing media S are loaded is at the lift-down position (rotation limit position in the arrow A2 direction) P20, and the lever 48 is at the standby position (rotation limit position in the arrow B2 direction) P30. In this state, the first position detection sensor 81 is off because the light shielding plate 50 is positioned between the light emitting unit and light receiving unit of the first position detection sensor 81, and the second position detection sensor 82 is on because the light shielding plate 50 is not present between the light emitting unit and light receiving unit of the second position detection sensor 82. In addition, in this standby state, the lever 90 is at the standby position (rotation limit position in the arrow C1 direction) as illustrated in FIG. 15A because the printing media S on the intermediate plate 31 are not in contact with the lever 90. In this state, the sheet detection sensor 83 is off because the light shielding plate 91 is positioned between the light emitting unit and light receiving unit of the sheet detection sensor 83.

As described above, in the standby state illustrated in FIG. 14A, the first position detection sensor 81 is off, the second position detection sensor 82 on, and the sheet detection sensor 83 off.

From the standby state as above, the main controller 101 or the print controller 202 in FIG. 2 moves up the intermediate plate 31 in the arrow A1 direction (step S1) as illustrated in FIG. 14B. Specifically, the main controller 101 or the print controller 202 causes the motor 46 to rotate in one direction to rotate the lift lever 41 in the arrow B1 direction together with the rotation member 43 and the shaft 42, and move up the intermediate plate 31 in the arrow A1 direction according the rotation of the lift lever 41. Then, when the sheet detection sensor 83 turns on, or when the second position detection sensor 82 turns off, the upward movement of the intermediate plate 31 is stopped (steps S3 and S4).

The sheet detection sensor 83 turns on when the lever 90 comes into contact with the printing medium S at the uppermost position of the printing media S loaded on the intermediate plate 31 and rotates to a specified position P41 in the arrow C2 direction as illustrated in FIG. 15B, and the light shielding plate 91 moves away from the space between the light emitting unit and the light receiving unit. The sheet detection sensor 83 turns on when the printing medium S at the uppermost position of those loaded on the intermediate plate 31 is put in the state where it is ready to be conveyed by the pick-up roller 61. As described above, when the printing medium S at the uppermost position on the intermediate plate 31 is put in the state where it is ready to be conveyed by the pick-up roller 61, the sheet detection sensor 83 turns on, and the upward movement of the intermediate plate 31 stops.

Figure 14C:
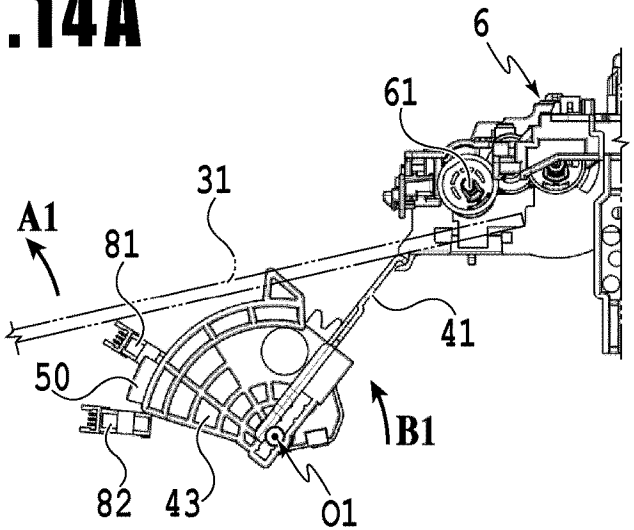

The second position detection sensor 82 turns off when the lever 48 rotates to the position P31 in the arrow B1 direction, and the light shielding plate 50 gets to a position between the light emitting unit and the light receiving unit, as illustrated in FIG. 14D. The slit 43A of the rotation member 43 and the connecting portion 48A of the lever 48 illustrated in FIG. 13 start interfering with each other when the rotation member 43 rotates from the standby state illustrated in FIG. 14A by a specified amount in the arrow B1 direction. With this structure, when the rotation member 43 rotates in the arrow B1 direction by more than the specified amount, the lever 48 rotates in the arrow B1 direction together with the rotation member 43 as illustrated in FIGS. 14B, 14C, and 14D. The second position detection sensor 82 is off, when the intermediate plate 31 moves up, and the sheet detection sensor 83 remains off, in other words, when the printing media S are not loaded on the intermediate plate 31.

When the printing medium S at the uppermost position on the intermediate plate 31 is put in the state where it is ready to be conveyed by the pick-up roller 61, and the sheet detection sensor 83 turns on, the state (on or off) of the first position detection sensor 81 varies depending on the number of remaining printing media S loaded on the intermediate plate 31. The main controller 101 or the print controller 202 illustrated in FIG. 2 includes a function to estimates the number of remaining printing media S and estimates the number of remaining printing media S loaded on the intermediate plate 31 based on the states (detection results) of these first position detection sensor 81, second position detection sensor 82, and sheet detection sensor 83 (step S5).

FIG. 14B illustrates the state where the rotation member 43 rotated in the arrow B1 direction together with the shaft 42 and the lift lever 41 by the specified amount; when the lever 48 started rotating in the arrow B1 direction together with the rotation member 43, the sheet detection sensor 83 turned on; and the upward movement of the intermediate plate 31 has stopped. In this state, the stop position of the intermediate plate 31 is relatively low, the first position detection sensor 81 remains off, and the second position detection sensor 82 remains on. In other words, in the state illustrated in FIG. 14B, the first position detection sensor 81 is off, the second position detection sensor 82 on, and the sheet detection sensor 83 on. In this state, it can be estimated that the number of remaining printing media S loaded on the intermediate plate 31 is large, as shown in FIG. 17.

FIG. 14C illustrates the state where when the lever 48 rotated together with the rotation member 43, shaft 42, and lift lever 41 further in the arrow B1 direction from the state illustrated in FIG. 14B, the sheet detection sensor 83 turned on, and the upward movement of the intermediate plate 31 has stopped. In this state, the stop position of the intermediate plate 31 is relatively high, the first position detection sensor 81 is on because the light shielding plate 50 has moved away from the space between the light emitting unit and the light receiving unit, and the second position detection sensor 82 remains on. In other words, in the state illustrated in FIG. 14C, the first position detection sensor 81 is on, the second position detection sensor 82 on, and the sheet detection sensor 83 on. In this state, it can be estimated that the number of remaining printing media S loaded on the intermediate plate 31 is small, as illustrated in FIG. 17.

FIG. 14D illustrates the state where while the intermediate plate 31 was moving up, the sheet detection sensor 83 did not turn on, and the second position detection sensor 82 has turned off, as described above. In this state, the first position detection sensor 81 is on, the second position detection sensor 82 off, and the sheet detection sensor 83 off. In this state, it can be estimated that there is no printing medium S loaded on the intermediate plate 31 (the printing medium S is not loaded), as illustrated in FIG. 17.

As described above, in the present embodiment, the number of remaining printing media S loaded on the intermediate plate 31 can be estimated in three levels—"a large number of sheets remain", "a small number of sheets remain", and "no sheet remains"—according to the states (on or off) of the first position detection sensor 81, second position detection sensor 82, and sheet detection sensor 83. In addition, even when the speed of the upward movement of the intermediate plate 31 varies depending on the degree of the number of remaining printing media S on the intermediate plate 31, the number of remaining printing media S can be estimated without errors.

Other Embodiments

The above embodiment includes the first position detection sensor 81 and second position detection sensor 82 (a detection unit) as the position detection sensors for detecting the lift-up position of the intermediate plate 31 and further combines these with the sheet detection sensor 83 to estimate the number of remaining printing media S in three levels as illustrated in FIG. 17. However, if three or more sensors are used as the position detection sensors, the number of remaining printing media S can be estimated in more detail, such as in four or more levels. In addition, these sensors are not limited to optical sensors, but any sensor can be used as long as the sensor is capable of detecting the lift-up position of the intermediate plate 31.

The present invention can be applicable not only to sheet feeding devices for feeding sheets as printing media and printing apparatuses including the same, but can also be widely applicable to sheet feeding devices for feeding various sheets and sheet processing apparatuses including the same. For example, the present invention is applicable to feeding devices for document sheets and image scanning apparatuses including the same as well as feeding devices for sheets to be punched or bent and sheet processing apparatuses including the same.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-250570 filed Dec. 27, 2017, which is hereby incorporated by reference herein in its entirety.

What is claimed is:

1. A sheet feeding device comprising:

a loading member on which sheets are loaded;

a lift unit that moves the loading member up and down;

a position detection unit that detects a lift-up position to which the loading member moves up;

a sheet detection unit that detects that a sheet at an uppermost position of the sheets loaded on the loading member has moved up to a feeding position by an upward movement of the loading member;

a feeding roller that feeds a sheet at the feeding position; and an estimation unit that estimates the number of remaining sheets loaded on the loading member based on a combination of detection results of the sheet detection unit and the position detection unit.

2. The sheet feeding device according to claim 1, wherein the estimation unit estimates the number of remaining sheets loaded in the loading member when the sheet detection unit detects that the sheets on the loading member have moved up to the feeding position based on the lift-up position of the loading member detected by the position detection unit.

3. The sheet feeding device according to claim 1, wherein the lift unit stops moving up the loading member when the sheet detection unit detects that the sheets on the loading member have moved up to the feeding position.

4. The sheet feeding device according to claim 1, wherein the estimation unit estimates that there is no remaining sheet loaded on the loading member when the position detection unit detects that the loading member has moved up higher than a specified position without the sheet detection unit detecting that the sheet at the uppermost position of the sheets loaded on the loading member has moved up to the feeding position.

5. The sheet feeding device according to claim 4, wherein the lift unit stops moving up the loading member when the position detection unit detects that the loading member has moved up higher than the specified position.

6. The sheet feeding device according to claim 1, wherein the position detection unit detects the lift-up position of the loading member stepwise, and the estimation unit estimates the number of remaining sheets on the loading member stepwise according to the lift-up position of the loading member detected stepwise by the position detection unit.

7. The sheet feeding device according to claim 6, wherein the position detection unit includes multiple detection units for detecting the lift-up position of the loading member stepwise.

8. The sheet feeding device according to claim 7, wherein the multiple detection units are each switched on and off according to the lift-up position of the loading member.

9. The sheet feeding device according to claim 1, wherein the sheet detection unit is disposed upstream of the feeding roller with respect to a sheet feeding direction.

10. The sheet feeding device according to claim 1, wherein the loading member is disposed in a cassette movable between an inside position inside a main body of the sheet feeding device and an outside position outside the main body, and the lift unit includes a drive unit positioned inside the main body and a power transmission system that is formed between the drive unit and the loading member when the cassette is at the inside position and is not formed when the cassette is at the outside position.

11. A printing apparatus comprising:

a loading member on which sheets are loaded;

a lift unit that moves the loading member up and down;

a position detection unit that detects a lift-up position to which the loading member moves up;

a sheet detection unit that detects that a sheet at an uppermost position of the sheets loaded on the loading member has moved up to a feeding position by an upward movement of the loading member;

a feeding roller that feeds a sheet at the feeding position;

an estimation unit that estimates the number of remaining sheets loaded on the loading member based on a combination of detection results of the sheet detection unit and the position detection unit; and a printing unit that performs printing on the sheet fed by the feeding roller.

* * * * *